United States Patent [19]

Hull

[11] 4,059,859

[45] Nov. 29, 1977

[54] LIFE RING

[76] Inventor: Evan B. Hull, 49 Pleasant St., Northboro, Mass. 01532

[21] Appl. No.: 688,737

[22] Filed: May 21, 1976

[51] Int. Cl.[2] ..... B63C 9/08

[52] U.S. Cl. ..... 9/340

[58] Field of Search ..... 9/311, 14, 329, 337, 9/340, 347, 310 R; D34/43

[56] References Cited

U.S. PATENT DOCUMENTS

| | | | |
|---|---|---|---|
| 175,828 | 4/1876 | Fife | 9/340 |
| 1,156,749 | 10/1915 | Brown | 9/340 |
| 3,032,789 | 5/1962 | Fedorowicz | 9/340 |
| 3,594,836 | 7/1971 | Robertson | 9/340 |

FOREIGN PATENT DOCUMENTS

| | | | |
|---|---|---|---|
| 68,406 | 12/1913 | Switzerland | 9/340 |

*Primary Examiner*—Trygve M. Blix
*Assistant Examiner*—Jesus D. Sotelo
*Attorney, Agent, or Firm*—Norman S. Blodgett; Gerry A. Blodgett

[57] ABSTRACT

Life ring having apertured main body of foamed plastic with a secondary ring rigidly attached to it by connecting members.

6 Claims, 6 Drawing Figures

PLAN

BOTTOM

FRONT ELEVATION

LIFE RING

BACKGROUND OF THE INVENTION

Traditionally, life rings have been made in the form of a circular annuli covered with canvas. Occasionally, a rope has been provided around the outer periphery of the annulus and loosely attached at several points. The rope provides the swimmer with means for grasping the ring toward him, after which he can loop his arm through the center opening. Such life rings are difficult to throw to any distance and with accuracy because the volume necessary to provide flotation for a grown man dictates a thick annulus if the size is to be restricted a reasonable amount. Furthermore, the cork-and-canvas construction results in a hard structure that can actually injure the swimmer if he is struck with it. Such a construction is also quite expensive, which means that the use of such life rings is perhaps less widespread than desirable. In addition, the loose rope tends to droop under water and is difficult to grasp in rough seas, particularly if the swimmer is tired and weak. These and other difficulties experienced with the prior art devices have been obviated in a novel manner by the present invention.

It is, therefore, an outstanding object of the invention to provide a life ring of simple, inexpensive construction that will lead to more extensive use.

Another object of this invention is the provision of a life ring that is easy to grasp and retain even in rough water.

A further object of the present invention is the provision of a life ring that is capable of a long life of useful service, even under unfavorable weather conditions, with a minimum of maintenance.

It is a further object of the instant invention to provide a life ring that can be thrown a substantial distance with considerable accuracy even by persons lacking great strength.

A still further object of the invention is to provide a life ring capable of retaining its bright color despite exposure to dirt and the like, so that its position will remain evident under all conditions.

It is a further object of the invention to provide a life ring that is easy for a rescuer to throw and for the rescued to grasp.

It is a still further object of the present invention to provide a life ring that is light in weight and soft to the touch, so that the swimmer cannot be injured.

Another object of the invention is the provision of a life ring having a high flotation-to-weight ratio.

Another object of the invention is the provision of a life ring particularly constructed to lie flat against a supporting surface with no protruding elements.

Another object of the invention is the provision of a life ring having a secondary ring that is visually evident and stands out from the main flotation ring, so that it is easy to grasp.

With these and other objects in view, as will be apparent to those skilled in the art, the invention resides in the combination of parts set forth in the specification and covered by the claims appended hereto.

SUMMARY OF THE INVENTION

In general, the present invention relates to a life ring having a main body of ring-like configuration formed of a flotation material, having a secondary ring surrounding and spaced from the main body, and having connecting members joining the main body to the secondary ring.

More specifically, the flotation material is foamed plastic and the main body is covered with a skin of unfoamed plastic. The cross-sectional shape of the main body is generally triangular with rounded corners. It is provided with a plane bottom surface and the secondary ring is located adjacent that ring.

BRIEF DESCRIPTION OF THE DRAWINGS

The character of the invention, however, may be best understood in reference to one of its structural forms, as illustrated by the accompanying drawings, in which.

DESCRIPTION OF THE PREFERRED EMBODIMENT

Figure 1:
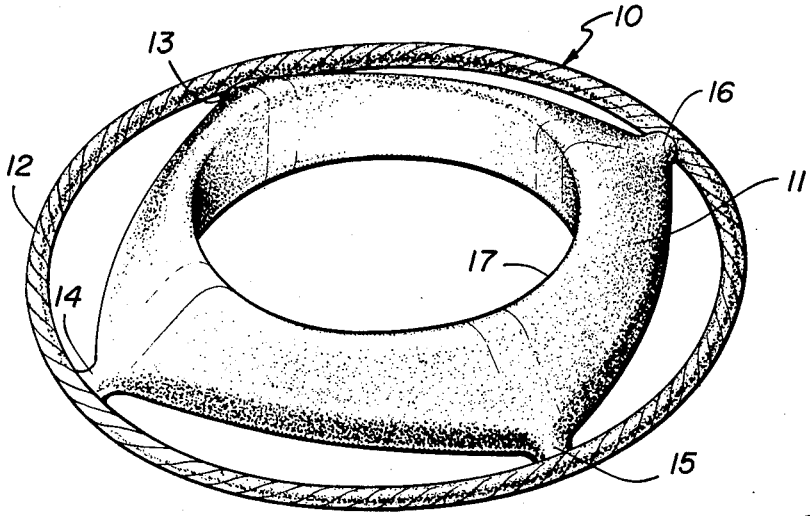
FIG. 1 is a perspective view of a life ring embodying the principles of the present invention.

Referring first to FIG. 1, which best shows the general features of the invention, the life ring, indicated generally by the reference numeral 10, is shown as consisting of a main body 11, a secondary ring 12, and connecting members 13, 14, 15, and 16. The main body 11 has a ring-like configuration with a circular central aperture 17 and is formed of a flotation material. The secondary ring 12 is considerably thinner than the main body, surrounding it, and is spaced from its outer periphery. The connecting members are integrally formed with the main body and formed of the same material.

Figure 2:
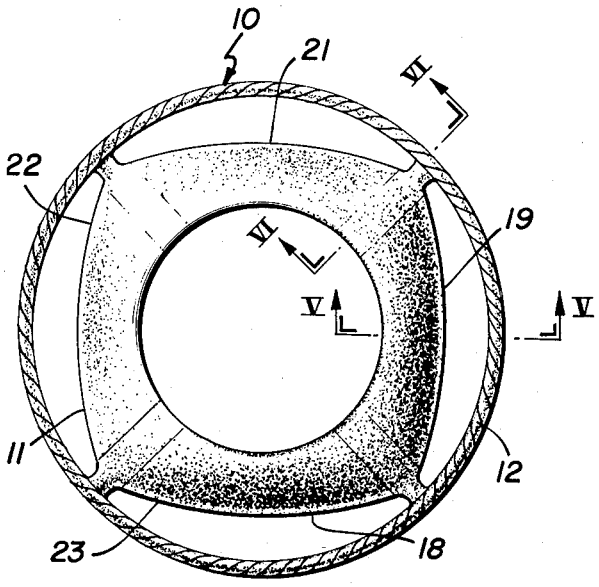
FIG. 2 is a top plan view of the life ring.
Figure 3:
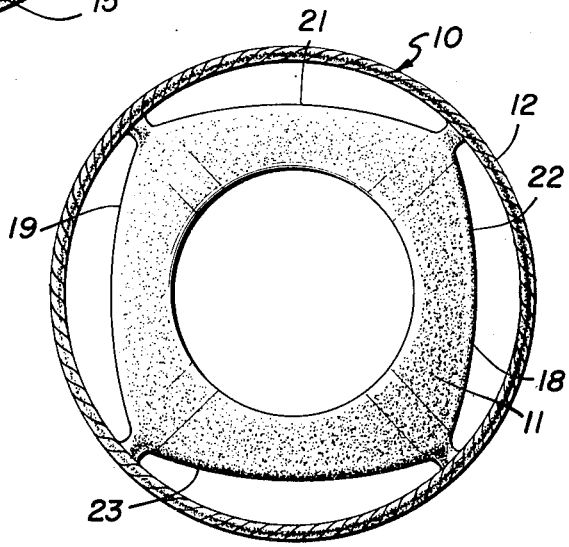
FIG. 3 is a bottom plan view of the life ring.

Referring to FIGS. 2 and 3, the outer periphery 18 of the main body is the shape of a four-sided figure having sides 19, 21, 22, and 23. The sides are of equal length and each side is in the form of the arc of a circle whose radius of curvature is substantially larger than the radius of the circular aperture 17. The connecting members 13, 14, 15, and 16 are located at the intersections of the sides and extend from the outer periphery of the main body in directions generally radial of the aperture.

Figure 5:
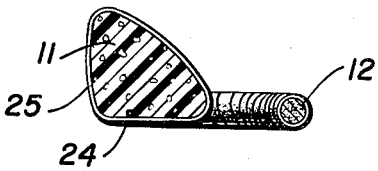
FIG. 5 is a vertical sectional view of the invention taken on the line V—V of FIG. 2.
Figure 4:
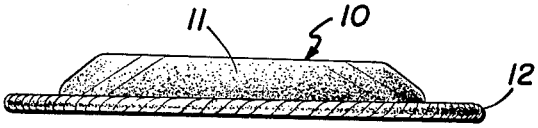
FIG. 4 is a front elevational view of the invention.
Figure 6:
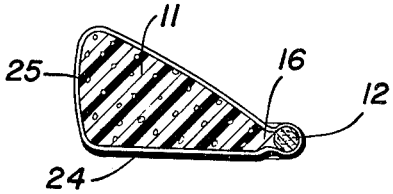
FIG. 6 is a vertical sectional view of the invention taken on line VI—VI of FIG. 2.

As is evident in FIGS. 5 and 6, the flotation material is a foamed plastic, such as foamed polyurethane, with the outer surface covered with a skin of the unfoamed made of the same plastic. This material is known as "structural foam" and is produced by the injection of the warm, molten foamed thermoplastic into a closed mold; the contact of the thermoplastic with the cold surface of this mold cavity causes the bubbles on the outer surface to collapse to form a dense, impermeable outer skin. A highly-visible dye, such as DAY-GLO, is incorporated in the plastic, so that the outer surface is very evident even under adverse conditions of visibility. The outer secondary ring 12 is in the form of a circle of fibre rope, preferably covered with a layer of and impregnated with the plastic to make it quite rigid.

The cross-sectional shape of the main body is generally triangular with rounded vertices or corners. A first side 24 defines a bottom plate surface, a second side 25 defines the surface of the aperture 17, and the third side 26, of course, joins the other two. The cross-sectional form of the secondary ring is circular and tangential to the said bottom plane surface.

The operation of the life ring will be readily evident from the above description. Normally, the life ring will be hung from a hook extending from a vertical flat surface on a wall or bulkhead. It would be resting with the surface 24 and the secondary ring 12 against the wall. In this condition, no element protrudes from the wall for accidental engagement by a passer-by. In the event of a water accident, as when a man falls overboard into the sea, a would-be rescuer removes the life ring from the hook. He grasps it by the outer ring 12 and is able to throw it with a slight spin about the axis of the aperture 17. The motion is similar to the action of a small boy in "scaling" a flat stone over the water. Because of the thin formation of the secondary ring, the user is able to grasp it firmly and, because it is rigidly connected to the main body, he is able to skim it over the surface of the water and to direct it accurately to the vicinity of the person in the water. Preferably, the ring is caused to land on the water with the surface 24 facing upwardly. In this condition, the outer ring 12 is held high in the water and can be readily seen and grasped by the victim of the accident.

The advantages of the invention will be evident from the above description. It is the nature of foamed plastic that it has considerable buoyancy, i.e., the ratio of flotation to weight is very high. At the same time, it is very strong and is not likely to be broken by rough treatment during the rescue. The lightness obviates the danger of the person in the water being hurt if he is accidentally struck during the throwing operation. The dense nature of the outer skin prevents the life ring from becoming water-logged and also assures that dust does not become permanently embedded in the surface, thus rendering it less than highly visible. The fact that the plastic is resistant to chemical action means that it can hang on its hook for a long period of time waiting for emergency without deteriorating, even though the atmosphere may be corrosive, as in the case of salt air. The dye which is incorporated in the plastic tends to remain active (and highly visible) over long periods of time, despite neglect and lack of maintenance.

Because the secondary ring 12 is rigid and integral with the main body, it is readily grasped by the man in the water; his motions in attempting to grasp it will not push it under water and out of sight. In other words, this rigidity assists the rescuer in making an accurate cast and assists the person to be rescued to draw it near to him.

With these and other objects in view, as will be apparent to those skilled in the art, the invention resides in the combination of parts set forth in the specification and covered by the claims appended hereto.

I claim:

1. Life ring, comprising:

a. main body of ring-like configuration with a cross-section in the shape of a closed plane figure, formed of flotation material, and having a circular central aperture, the outer periphery of the main body being in the shape of a multi-sided figure having corners in which the sides are of equal length, each of the sides being in the form of the arc of a circle whose radius of curvature is substantially larger than the radius of the aperture, the cross-sectional shape of the main body being generally triangular with rounded corners, one side defining a bottom plane surface, a second side defining a central aperture in the main body, the said bottom plane surface being perpendicular to the axis of the central aperture, b. a circular rigid secondary ring located externally of the main body and generally in the said bottom plane surface, and c. means joining the outer periphery of the main body to the secondary ring at the said corners.

2. Life ring as recited in claim 1, wherein the flotation material is foamed plastic and the main body is covered with a skin of unfoamed plastic.

3. Life ring as recited in claim 2, wherein the connecting members are integral with the main body and are similarly formed of foamed plastic with an unfoamed skin.

4. Life ring as recited in claim 3, wherein the secondary ring is formed of fibre rope.

5. Life ring as recited in claim 4, wherein the cross-sectional form of the secondary ring is circular and tangential to the said bottom plane surface.

6. Life ring as recited in claim 1, wherein the said means consists of connecting members which are located at the intersections of the sides and extend from the outer periphery of the main body in a direction generally radial of the aperture.

* * * * *